US006219869B1

(12) United States Patent
Burba

(10) Patent No.: US 6,219,869 B1
(45) Date of Patent: Apr. 24, 2001

(54) POCKETKNIFE WITH STORAGE COMPARTMENT

(76) Inventor: Peggy Burba, 614 10th St., Woodward, OK (US) 73801

( * ) Notice: Subject to any disclaimer, the term of this patent is extended or adjusted under 35 U.S.C. 154(b) by 0 days.

(21) Appl. No.: 09/234,655

(22) Filed: Jan. 21, 1999

(51) Int. Cl.[7] ..... B26B 11/00
(52) U.S. Cl. ..... 7/118; 7/162
(58) Field of Search ..... 7/106, 118, 151, 7/162, 170; 81/DIG. 1

(56) References Cited

U.S. PATENT DOCUMENTS 1,398,583 * 11/1921 Bovee ..... 7/118 X
1,731,287 * 10/1929 Barnowitz ..... 7/162 X
4,524,646 * 6/1985 Kimberlin ..... 7/901 X
5,806,380 * 9/1998 Wilsey ..... 7/151 X

* cited by examiner

*Primary Examiner*—James G. Smith

(57) ABSTRACT

A pocketknife with storage compartment for holding small items in the pocketknife. The pocketknife with storage compartment includes a handle comprising spaced apart side bodies and a plurality of tools pivotally coupled to the handle between the side bodies of the handle. A first of the side bodies has a compartment therein. A lid substantially covers the compartment. The lid is pivotally coupled to the first side body.

1 Claim, 2 Drawing Sheets

POCKETKNIFE WITH STORAGE COMPARTMENT

BACKGROUND OF THE INVENTION

1. Field of the Invention

The present invention relates to pocketknives and more particularly pertains to a new pocketknife with storage compartment for holding small items in the pocketknife.

2. Description of the Prior Art

The use of pocketknives is known in the prior art. More specifically, pocketknives heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 3,760,438 by White; U.S. Pat. No. 2,718,695 by Elsener; U.S. Pat. No. 2,286,524 by Wilbur; U.S. Pat. No. 5,400,509 by Collins; U.S. Pat. No. 4,478,330 by Lin; and U.S. Pat. No. Des. 83,791 by Brown.

While these devices fulfill their respective, particular objectives and requirements, the aforementioned patents do not disclose a new pocketknife with storage compartment. The inventive device includes a handle comprising spaced apart side bodies and a plurality of tools pivotally coupled to the handle between the side bodies of the handle. A first of the side bodies has a compartment therein. A lid substantially covers the compartment. The lid is pivotally coupled to the first side body.

In these respects, the pocketknife with storage compartment according to the present invention substantially departs from the conventional concepts and designs of the prior art, and in so doing provides an apparatus primarily developed for the purpose of holding small items in the pocketknife.

SUMMARY OF THE INVENTION

In view of the foregoing disadvantages inherent in the known types of pocketknives now present in the prior art, the present invention provides a new pocketknife with storage compartment construction wherein the same can be utilized for holding small items in the pocketknife.

The general purpose of the present invention, which will be described subsequently in greater detail, is to provide a new pocketknife with storage compartment apparatus and method which has many of the advantages of the pocketknives mentioned heretofore and many novel features that result in a new pocketknife with storage compartment which is not anticipated, rendered obvious, suggested, or even implied by any of the prior art pocketknives, either alone or in any combination thereof.

To attain this, the present invention generally comprises a handle comprising spaced apart side bodies and a plurality of tools pivotally coupled to the handle between the side bodies of the handle. A first of the side bodies has a compartment therein. A lid substantially covers the compartment. The lid is pivotally coupled to the first side body.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new pocketknife with storage compartment apparatus and method which has many of the advantages of the pocketknives mentioned heretofore and many novel features that result in a new pocketknife with storage compartment which is not anticipated, rendered obvious, suggested, or even implied by any of the prior art pocketknives, either alone or in any combination thereof.

It is another object of the present invention to provide a new pocketknife with storage compartment which may be easily and efficiently manufactured and marketed.

It is a further object of the present invention to provide a new pocketknife with storage compartment which is of a durable and reliable construction.

An even further object of the present invention is to provide a new pocketknife with storage compartment which is susceptible of a low cost of manufacture with regard to both materials and labor, and which accordingly is then susceptible of low prices of sale to the consuming public, thereby making such pocketknife with storage compartment economically available to the buying public.

Still yet another object of the present invention is to provide a new pocketknife with storage compartment which provides in the apparatuses and methods of the prior art some of the advantages thereof, while simultaneously overcoming some of the disadvantages normally associated therewith.

Still another object of the present invention is to provide a new pocketknife with storage compartment for holding small items in the pocketknife.

Yet another object of the present invention is to provide a new pocketknife with storage compartment which includes a handle comprising spaced apart side bodies and a plurality of tools pivotally coupled to the handle between the side bodies of the handle. A first of the side bodies has a compartment therein. A lid substantially covers the compartment. The lid is pivotally coupled to the first side body.

Still yet another object of the present invention is to provide a new pocketknife with storage compartment that may be used to store various loose tools therein.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

With reference now to the drawings, and in particular to FIGS. 1 through 4 thereof, a new pocketknife with storage compartment embodying the principles and concepts of the present invention will be described.

As best illustrated in FIGS. 1 through 4, the pocketknife with storage compartment generally comprises a handle comprising spaced apart side bodies and a plurality of tools pivotally coupled to the handle between the side bodies of the handle. A first of the side bodies has a compartment therein. A lid substantially covers the compartment. The lid is pivotally coupled to the first side body.

Figure 1:
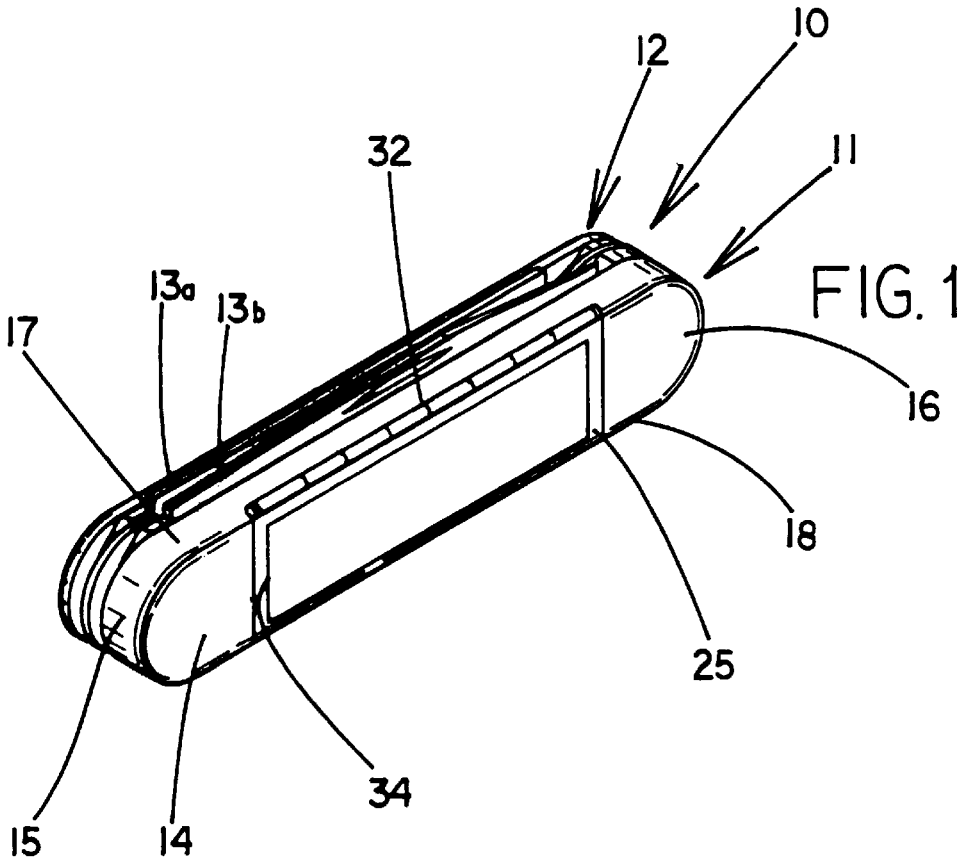
FIG. 1 is a schematic perspective view of a new pocketknife with storage compartment according to the present invention.
Figure 2:
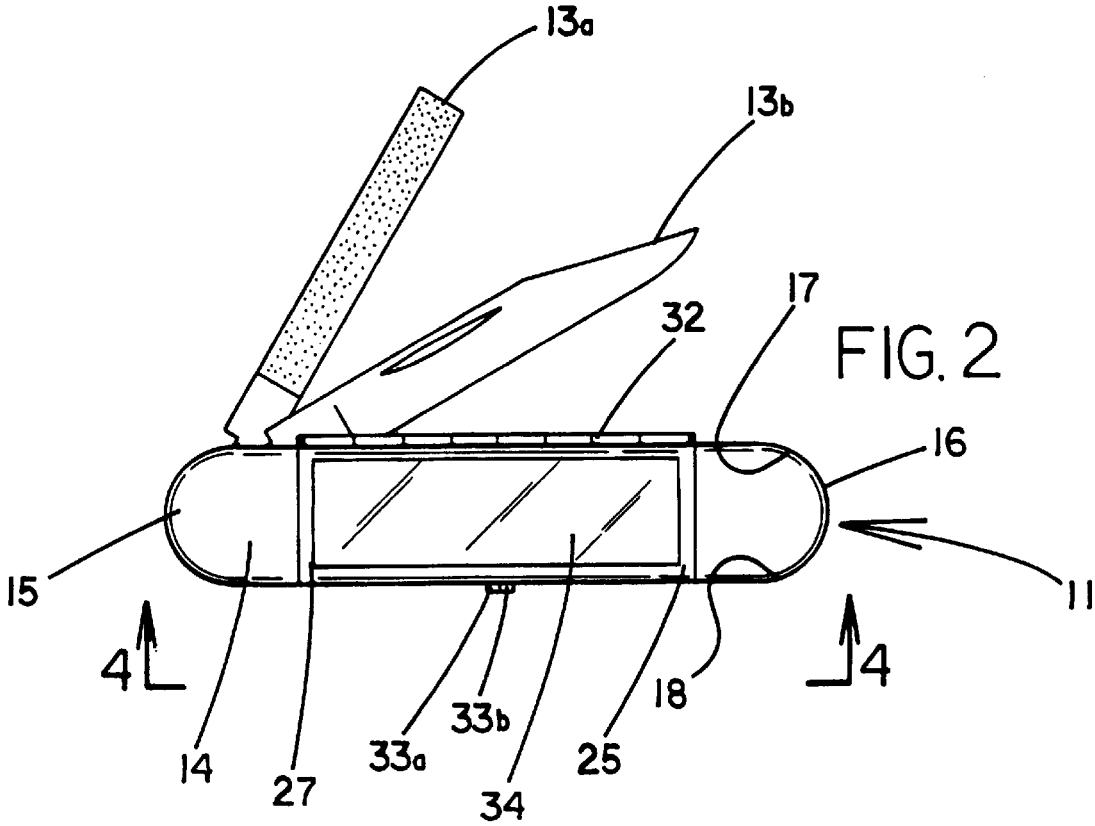
FIG. 2 is a schematic side view of the present invention with some tools pivoted out of the handle.

In closer detail, the pocketknife includes a generally oblong handle 10 comprising spaced apart generally oblong side bodies 11,12 and a plurality of tools 13*a*,13*b* pivotally coupled to the handle between the side bodies of the handle. As illustrated in FIG. 2, the tools may be any typical tool found in a conventional pocketknife including, for example, a knife blade and a file.

Each of the side bodies has an exterior face 14, a pair of opposite ends 15,16, and a pair of sides 17,18 extending between the ends of the respective side body. Ideally, the ends of each side body are rounded with the sides of each side body extending substantially parallel to one another.

The exterior face of a first of the side bodies has a generally rectangular compartment 19 therein. The compartment has a generally rectangular bottom wall 20 and a spaced apart pair of end walls 21,22 and a spaced apart pair of side walls 23,24 extending between the end walls of the compartment. Preferably, the end walls of the compartment are extended substantially parallel to one another and the side walls of the compartment are extended substantially parallel to one another and substantially perpendicular to the end walls of the compartment. Also preferably, the end walls and the side walls of the compartment are extended substantially perpendicular to the bottom wall of the compartment. In this preferred embodiment, the end walls of the compartment are extended substantially perpendicular to the sides of the first side body while the side walls of the compartment are extended substantially parallel to the sides of the first side body.

The first side body has a length defined between the ends of the first side body. The compartment has a length defined between the end walls of the compartment. Preferably, the length of the compartment is between about one-half the length of the first side body and about nine-tenths the length of the first side body. Ideally, the length of the first side body is between about 4 inches and about 8 inches.

A generally rectangular lid 25 substantially covers the compartment. The lid has inner and outer faces 26,27, a pair of substantially straight opposite end edges 28,29, and a pair of substantially straight side edges 30,31 extending between end edges of the lid. The inner face of the lid faces into the compartment when the lid is closed. The outer face of the lid and the exterior face of the first side body preferably substantially lie in a common plane with one another when the lid is closed.

A first of the side edges of the lid is pivotally coupled to the first side body adjacent one of the side walls of the compartment. In one preferred embodiment, a piano hinge 32 pivotally couples the lid to the first side body. Optionally, a plurality of smaller hinges may pivotally couple the lie to the first side body. A clasp detachably attaches a second of the side edges of the lid to the first side body adjacent the other of the side walls of the compartment. The clasp comprises a pair of complementary portions 33*a*,33*b* releasably engaging one another. One of the complementary portions of the clasp is provided on the lid while the other of the complementary portions of the clasp is provided on the first side body.

Figure 3:
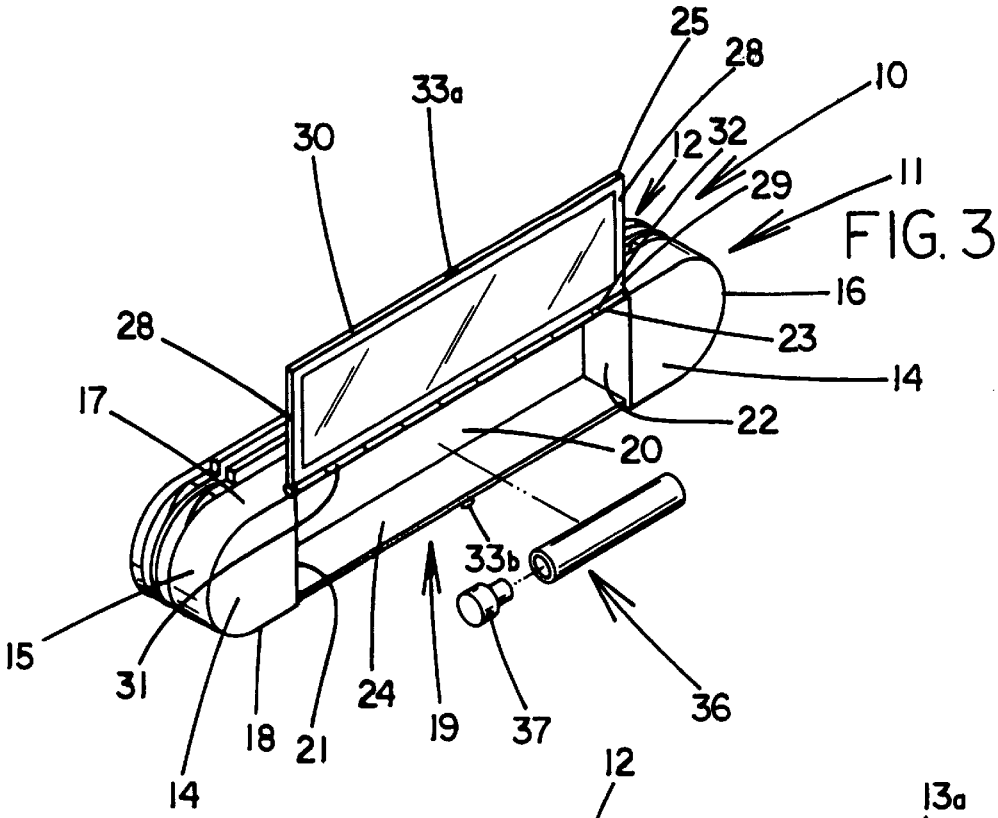
FIG. 3 is a schematic exploded perspective view of the present invention with the lid opened to reveal the compartment.
Figure 4:
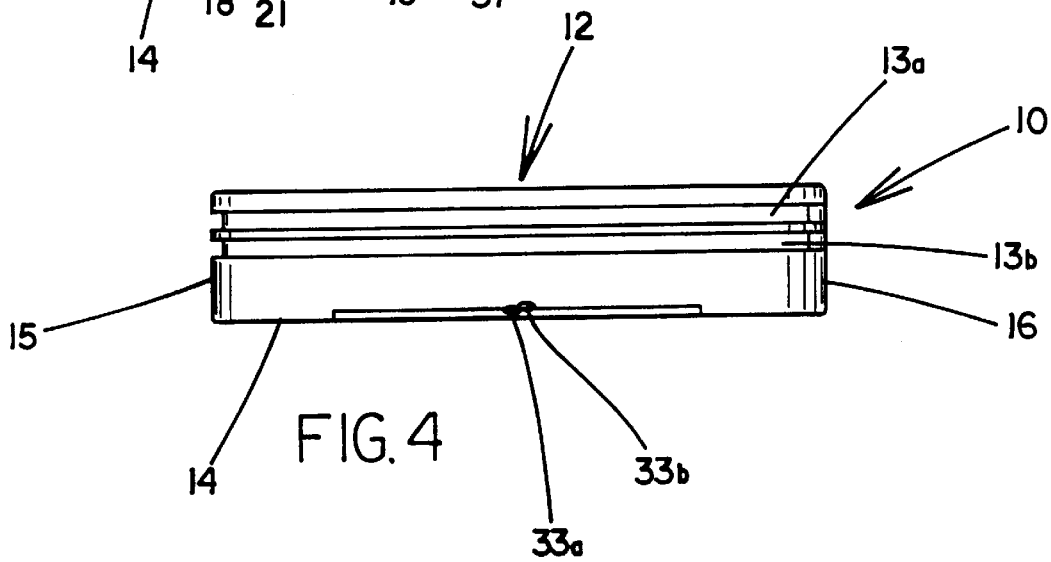
FIG. 4 is a schematic plan view of the present invention as seen from the vantage of line 4—4 of FIG. 2.

Preferably, a mirror 34 is provided on the lid. In one preferred embodiment, the mirror is located on the exterior face of the lid. With reference to FIG. 3, in another preferred embodiment this mirror or an additional mirror 35 may be located on the inner face of the lid. In one ideal embodiment, the mirror substantially covers the face of the lid on which the mirror is located.

Ideally, the exterior face of a second of side bodies is magnetized to permit magnetic attachment of the second side body to a magnetizable metal surface.

With reference to FIG. 3, an elongate tube 36 may be provided in the compartment having an open first end and a closed second end. The tube has a removable cap 37 substantially closing the open first end of the tube. The tube has a length defined between the first and second ends of the tube. Ideally, the length of the tube is between about the length of the compartment and about one-half the length of the compartment. In use, the tube is designed for holding small items such as needles therein in an organized manner in the compartment.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A pocketknife, comprising:

a generally oblong handle comprising spaced apart generally oblong side bodies and a plurality of tools pivotally coupled to said handle between said side bodies of said handle;

each of said side bodies having an exterior face, a pair of opposite ends, and a pair of sides extending between said ends of the respective side body;

wherein said ends of each side body are rounded, and wherein said sides of each side body are extended substantially parallel to one another;

said exterior face of a first of said side bodies having a generally rectangular compartment therein, said compartment having a generally rectangular bottom wall and a spaced apart pair of end walls and a spaced apart pair of side walls extending between said end walls of said compartment;

said end walls of said compartment being extended substantially parallel to one another, said side walls of said compartment being extended substantially parallel to one another and substantially perpendicular to said end walls of said compartment;

said end walls and said side walls of said compartment being extended substantially perpendicular to said bottom wall of said compartment;

said end walls of said compartment being extended substantially perpendicular to said sides of said first side body, said side walls of said compartment being extended substantially parallel to said sides of said first side body;

said first side body having a length defined between said ends of said first side body, said compartment having a length defined between said end walls of said compartment;

said length of said compartment being between about one-half said length of said first side body find about nine-tenths said length of said first side body;

wherein said length of said first body is between about 4 inches and about 8 inches;

a generally rectangular lid substantially covering said compartment, said lid having inner and outer faces, a pair of substantially straight opposite end edges, and a pair of substantially straight side edges extending between end edges of said lid;

said inner face of said lid facing into said compartment;

said outer face of said lid and said exterior face of said first side body substantially lying in a common plane with one another;

a first of said side edges of said lid being pivotally coupled to said first side body adjacent one of said side walls of said compartment;

a clasp detachably attaching a second of said side edges of said lid to said first side body adjacent the other of said walls of said compartment;

wherein said clasp comprises a pair of complementary portions releasably engaging one another, one of said complementary portions of said clasp being provided on said lid, the other of said complementary portions of said clasp being provided on said first side body;

a mirror being provided on said lid, said mirror being located on said exterior face of said lid, wherein said mirror substantially covers said exterior face of said lid;

wherein the exterior face of a second of side bodies has a magnet thereon to permit magnetic attachment of said second side body to a magnetizable metal surface such that said mirror and said magnet are located on opposite side bodies;

an elongate tube having an open first end and a closed second end, said tube being provided in said compartment;

said tube having a removable cap substantially closing said open first end of said tube;

said tube having a length defined between said first and second ends of said tube, wherein said length of said tube is between about said length of said compartment and about one-half said length of said compartment; and said tube being adapted for holding small items in an organized manner in said compartment.

* * * * *